US009022082B1

(12) United States Patent
Signalness

(10) Patent No.: US 9,022,082 B1
(45) Date of Patent: May 5, 2015

(54) COVER FOR THE SPOUT OF A FUEL DISPENSER AND METHOD OF USE

(71) Applicant: Bryan Richard Signalness, Vaughn, MT (US)

(72) Inventor: Bryan Richard Signalness, Vaughn, MT (US)

( * ) Notice: Subject to any disclaimer, the term of this patent is extended or adjusted under 35 U.S.C. 154(b) by 0 days.

(21) Appl. No.: 14/463,736

(22) Filed: Aug. 20, 2014

Related U.S. Application Data

(60) Provisional application No. 61/965,060, filed on Jan. 21, 2014.

(51) Int. Cl.
*B67D 7/54* (2010.01)
*B67D 7/42* (2010.01)
*B67D 7/84* (2010.01)

(52) U.S. Cl.
CPC . *B67D 7/421* (2013.01); *B67D 7/84* (2013.01)

(58) Field of Classification Search
CPC ..... B67D 7/421; B67D 7/84; B67D 7/04
USPC ..... 141/86, 311 A, 392, 1–2; 222/108, 571; 137/312
See application file for complete search history.

(56) References Cited

U.S. PATENT DOCUMENTS

| | | | | | |
|---|---|---|---|---|---|
| 2,087,139 | A * | 7/1937 | Cameron | 361/215 |
| 3,348,541 | A * | 10/1967 | Loebeck | 602/58 |
| 4,331,190 | A * | 5/1982 | Sutcliffe et al. | 141/392 |
| 5,165,574 | A * | 11/1992 | Ratcliffe | 222/108 |
| 5,571,249 | A * | 11/1996 | Boylen | 141/86 |
| 6,463,966 | B1 * | 10/2002 | Goodger | 141/86 |
| 6,640,825 | B2 * | 11/2003 | McAtarian | 137/312 |
| 2009/0014087 | A1 * | 1/2009 | Fevag | 141/86 |

* cited by examiner

*Primary Examiner* — Timothy L Maust
*Assistant Examiner* — Timothy P Kelly
(74) *Attorney, Agent, or Firm* — Ted Masters

(57) ABSTRACT

A cover for covering a spout of a fuel dispenser when the fuel dispenser is not in use includes a sheath having an elongated cavity which is shaped and dimensioned to longitudinally receive the spout of the fuel dispenser. The sheath is fabricated from a fuel absorbent material. After the fuel dispenser is used, the sheath is installed over the spout of the fuel container, absorbs any residual fuel, and prevents contaminants from collecting on the spout. In an embodiment, the sheath has a hole which receives the hanger of a fuel nozzle and holds the sheath in place on the spout.

4 Claims, 5 Drawing Sheets

COVER FOR THE SPOUT OF A FUEL DISPENSER AND METHOD OF USE

CROSS REFERENCE TO RELATED APPLICATION

This application claims the filing benefit under 35 U.S.C. §119(e) of U.S. Provisional Application No. 61/965,060, filed Jan. 21, 2014, which is hereby incorporated by reference.

TECHNICAL FIELD

The present invention pertains generally to fuel dispensers such as fuel nozzles and portable fuel containers, and more particularly to a cover which can be installed on the spout of the fuel dispenser.

BACKGROUND OF THE INVENTION

In many industries at job sites fuel is stored in tanks so that it can be locally dispensed to vehicles, machinery, tools, and the like. Sometimes the tanks are positioned on the ground, and other times in mobile vehicles such as in the bed of pickup trucks. These tanks are oftentimes referred to as transfer tanks, and consist of a fuel tank, fuel hose, and attached fuel nozzle. After the fuel hose and nozzle are used to fill a machine or other device, the nozzle is returned to its holder at the fuel tank for storage. However, after use the nozzles will sometimes leak fuel, thereby creating both a mess (such as on the side of the host pickup truck) and a potential safety hazard. Moreover, if the fuel tank is located in a windy or dirty environment, contaminants such as dirt and debris can adhere to the leaked fuel and accumulate on the fuel tank, accumulate on or inside the fuel nozzle, and possibly be passed to the receiving machine or other device. Similar problems can exist for portable fuel containers such as 5 gasoline cans. The present invention is directed to a solution for these problems.

BRIEF SUMMARY OF THE INVENTION

The present invention is directed to a cover which can be installed on the spout of a fuel dispenser such as a fuel nozzle or a portable fuel container when the fuel dispenser is not in use. The cover both (1) collects and absorbs residual fuel such as fuel drips from the spout of the fuel dispenser after it is used, and (2) protects the spout of the fuel dispenser from dirt, silt, debris, and other contaminants. The cover comprises a sheath which has a cavity (a pouch). The cavity is shaped and dimensioned to longitudinally receive and protect the spout of the fuel dispenser. The cover is very easy and quick to install and remove. After the fuel dispenser is used, the cover is slid over the spout of the fuel dispenser and connected to the spout. The cover absorbs residual fuel such as leaks, drips, and seepage from the spout after use, and prevents any contaminants from getting on the spout. The cover will fit most fuel nozzles, and can also be used on portable fuel containers which have a pouring spout. Use of the cover both eliminates fuel spills on the sides of pickup trucks, and prevents paint fade of the vehicles. Moreover, when used on portable fuel containers such as 5 gallon gas cans, the cover reduces spillage when the containers are moved from site to site.

In use the cover is first positioned so that the cavity receives the distil end of the spout of the fuel dispenser. The cover is then longitudinally pulled (slipped) over spout so that it covers the spout. Alternatively, the spout is longitudinally inserted into the cavity of the cover. In and embodiment, the cover is connected to a fuel nozzle by inserting the hanger of the fuel nozzle through a hole in hole in the cover.

In an embodiment, a cover for covering a spout of a fuel dispenser when the fuel dispenser is not in use, includes a sheath which has an elongated cavity which is shaped and dimensioned to receive the spout of the fuel dispenser. The sheath is fabricated from a fuel absorbent material.

In another embodiment, the sheath is fabricated from one or more layers of the fuel absorbent material.

In another embodiment, the sheath is fabricated from a plurality of layers of the fuel absorbent material which are stitched together to form the cavity.

In another embodiment, the sheath includes an outer layer of fuel and water resistant material.

In another embodiment, the fuel dispenser is a fuel nozzle having a hanger. The sheath has a hole which is shaped and dimensioned to receive the hanger of the fuel nozzle, so that the sheath is retained in place on the spout of the fuel nozzle.

In another embodiment, the sheath has a hole. A connector is shaped and dimensioned to fit through the hole and be connected around the fuel dispenser to retain the sheath in place on the spout of the fuel dispenser.

In another embodiment, the fuel dispenser is disposed in an environment which contains contaminants. When installed on the spout of the fuel dispenser, the sheath prevents the contaminants from collecting on the spout of the fuel dispenser.

Other embodiments, in addition to the embodiments enumerated above, will become apparent from the following detailed description, taken in conjunction with the accompanying drawings, which illustrate, by way of example, the principles of the cover and method of use.

DETAILED DESCRIPTION OF THE INVENTION

Figure 1:
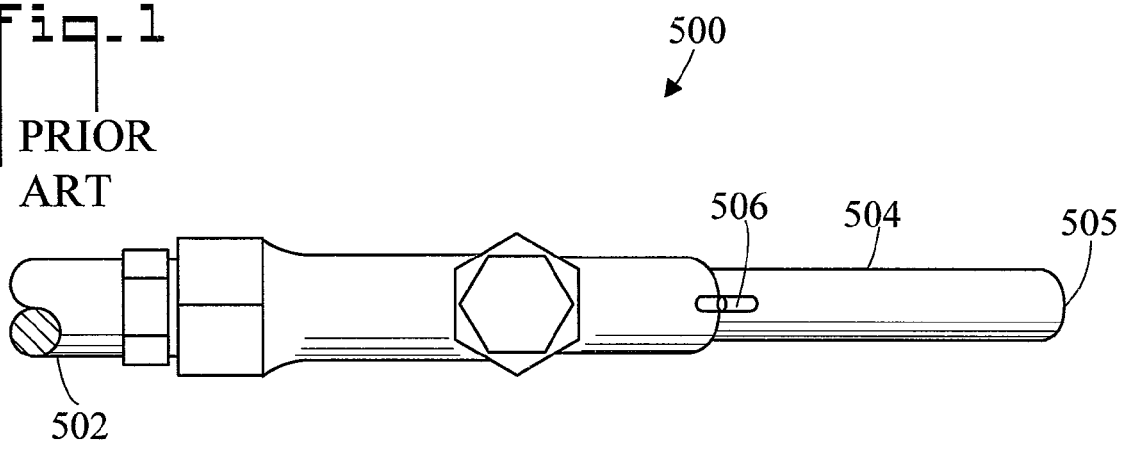
Fig. 1 PRIOR ART
FIG. 1 is a top plan view of a prior art fuel nozzle.
Figure 2:
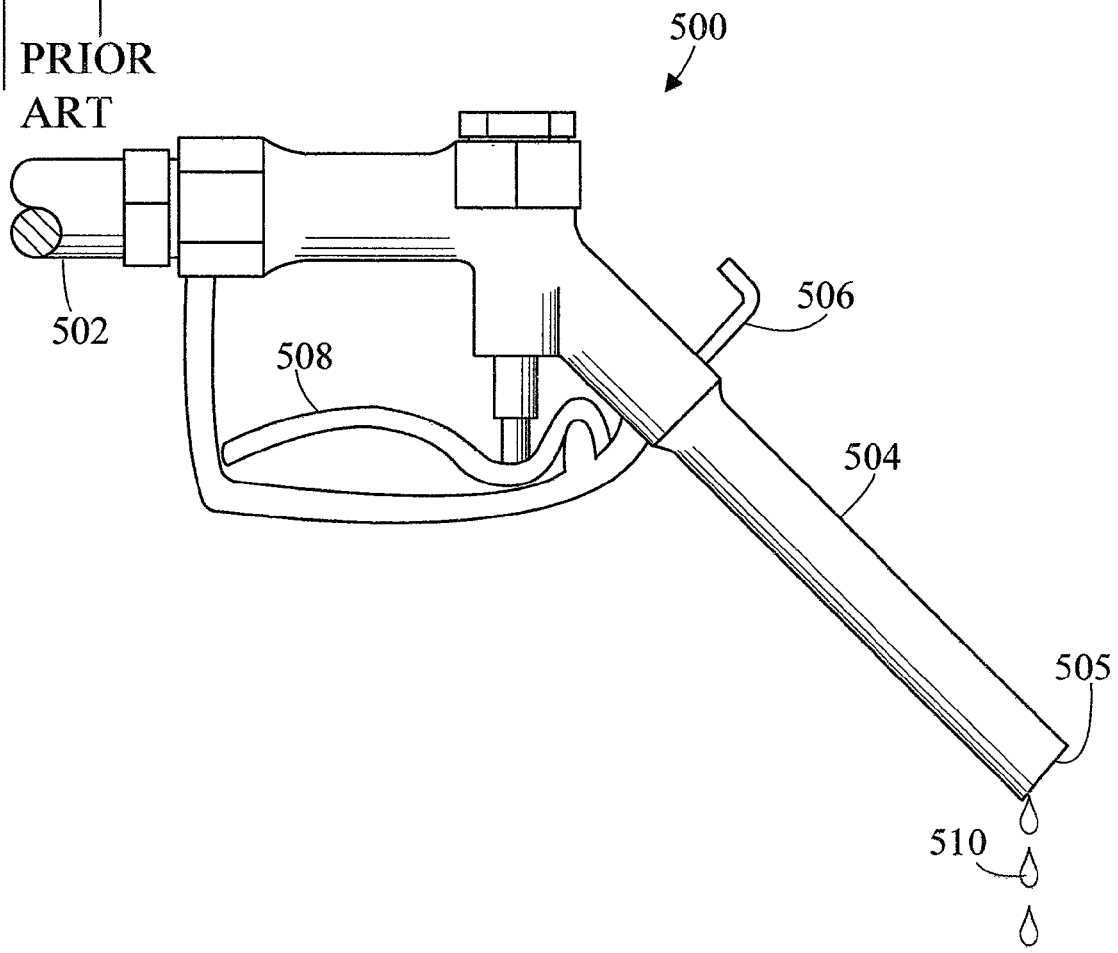
Fig. 2 PRIOR ART
FIG. 2 is a side elevation view of the prior art fuel nozzle.

FIGS. 1 and 2 are top plan and side elevation views respectively of a prior art fuel nozzle, generally designated as 500. Fuel nozzle 500 is connected to a fuel tank 600 by a fuel hose 502 (also refer to FIG. 13). Fuel nozzle 500 includes a spout 504 for dispensing fuel spout 504 having a distal end 505, a hanger 506 for storing fuel nozzle 500, and a fuel dispensing lever 508 which when pulled causes fuel to be dispensed from spout 504. It is noted that residual fuel 510 drips from spout 504 after fuel nozzle 500 is used.

Figure 3:
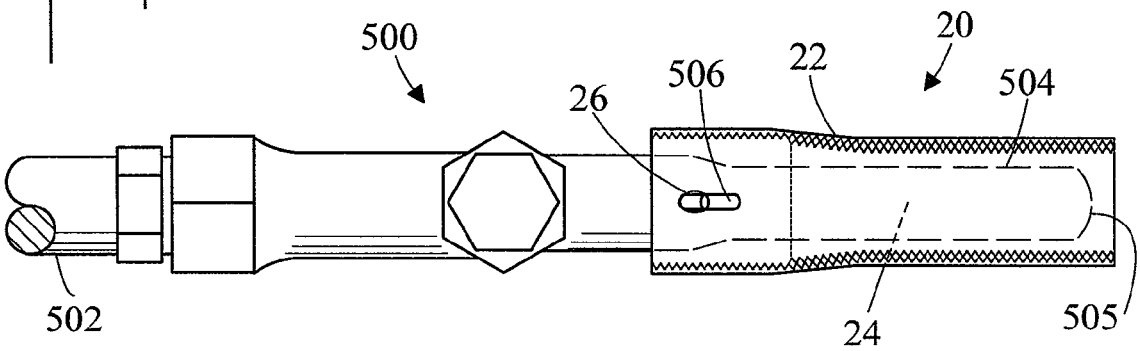
FIG. 3 is a top plan view of the fuel nozzle with a cover installed.
Figure 4:
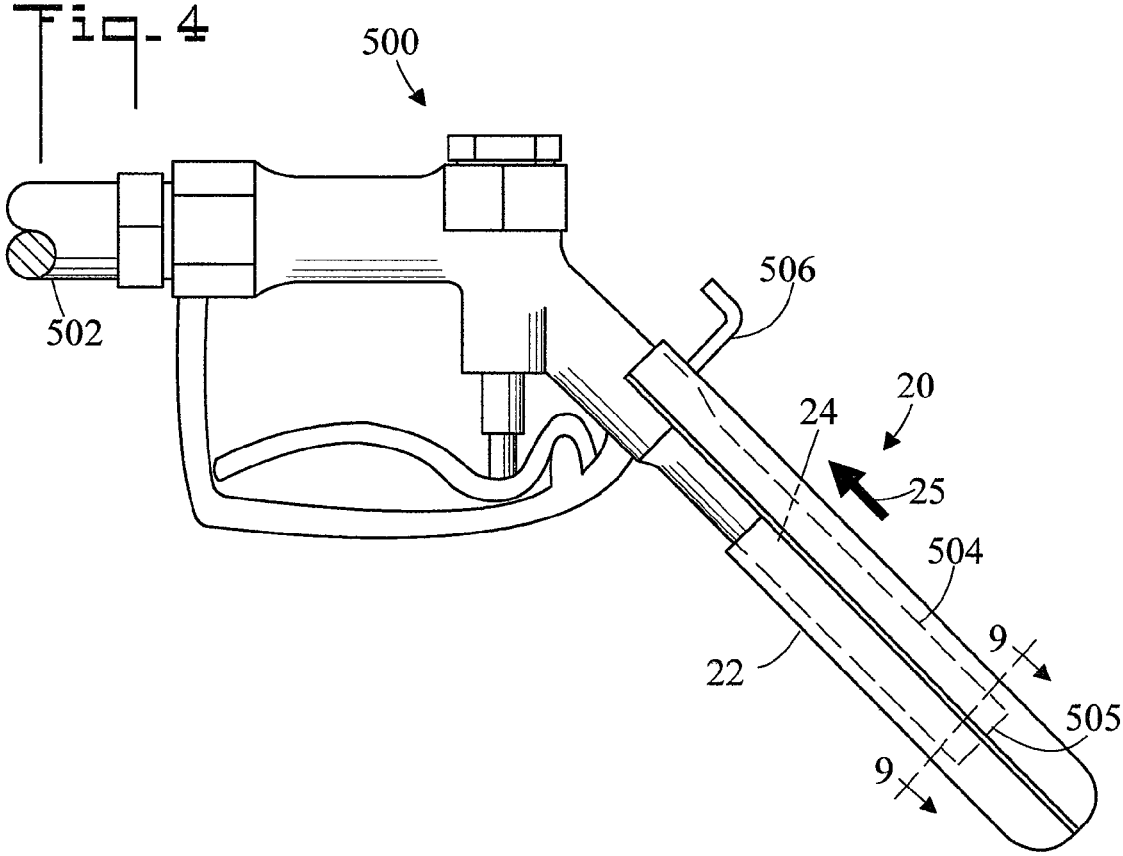
FIG. 4 is a side elevation view of the fuel nozzle with the cover installed.
Figure 5:
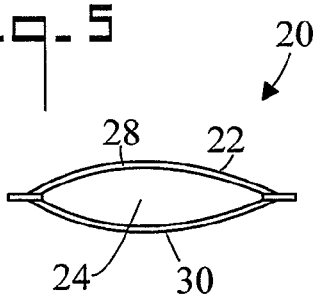
FIG. 5 is an end view of the cover.
Figure 9:
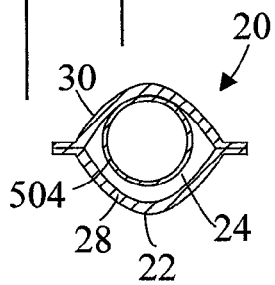
FIG. 9 is a cross sectional view along line 9-9 of FIG. 4.
Figure 6:
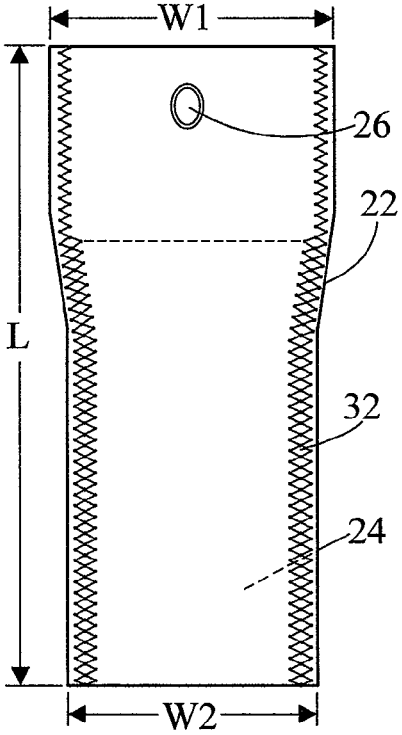
FIG. 6 is a top plan view of the cover.
Figure 7:
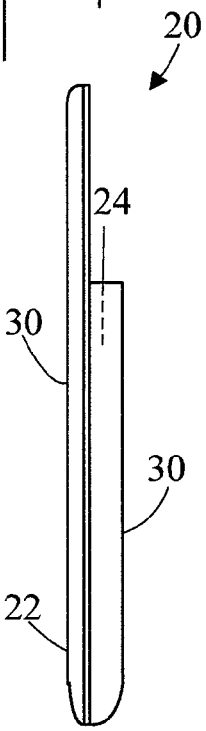
FIG. 7 is a side elevation view of the cover.
Figure 8:
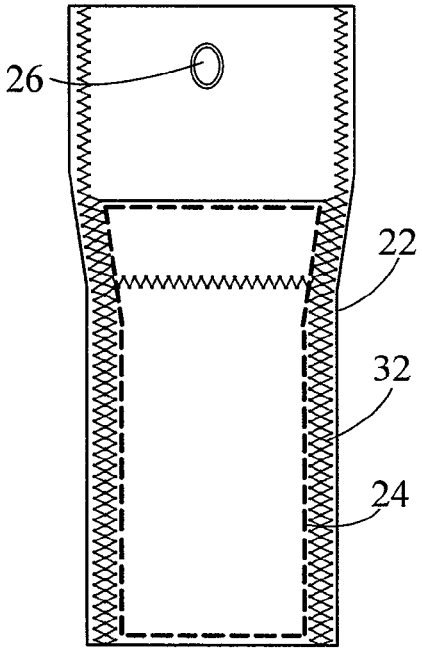
FIG. 8 is a bottom plan view of the cover.

FIGS. 3 and 4 are top plan and side elevation views respectively of fuel dispenser 500 (a fuel nozzle as shown) with a cover 20 installed. Cover 20 covers the spout 504 of fuel dispenser 500 when the fuel dispenser 500 is not in use. Cover 20 includes a flexible sheath 22 (closed pocket) which has an elongated cavity 24 which is shaped and dimensioned to longitudinally receive spout 504 of fuel dispenser 500. Sheath 22 is fabricated from a fuel absorbent material. Spout 504 of fuel dispenser 500 has been inserted into cavity 24, and cover 20 has been slid up along spout 504 in direction 25. That is, cover 20 serves as a sheath which is longitudinally installed over spout 504 (also refer to FIGS. 5-9).

A hole 26 in sheath 22 is shaped and dimensioned to receive hanger 506 of fuel nozzle 500, thereby retaining sheath 22 in place on spout 504 of fuel nozzle 500. Hanger 506 is pushed though hole 26. When so installed on spout 504, cover 20 both collects residual fuel 510 (refer to FIG. 2) such as drips from spout 504, and protects spout 504 from contaminants. In an embodiment fuel nozzle cover 20 has a length L of about 10.5 inches, a top width W1 of about 4.625 inches, and a bottom width W2 of about 4.0 inches.

FIGS. 5-9 are end, top plan, side elevation, bottom plan, and cross sectional views respectively of cover 20. In the shown embodiment, cover 20 is a sheath 22 which is fabricated from one or more layers (e.g. five) of fuel absorbent material 28 such as fuel absorbent padding. Sheath 22 includes an outer layer 30 of a fuel and water resistant material which keeps fuel from seeping out of fuel nozzle cover 20, and water from seeping in. In the shown embodiment the various layers are stitched together to form elongated cavity 24, thereby ensuring that cover 20 forms a closed pocket for collecting residual fuel 510 such as fuel drips. Elongated cavity 24 is shown in heavy dashed lines in FIG. 8.

Figure 10:
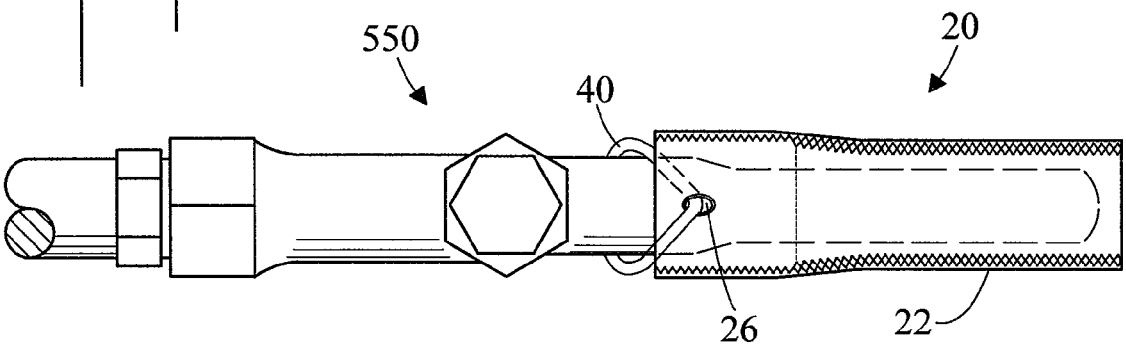
FIG. 10 is a top plan view of a second embodiment fuel nozzle with the cover installed.
Figure 11:
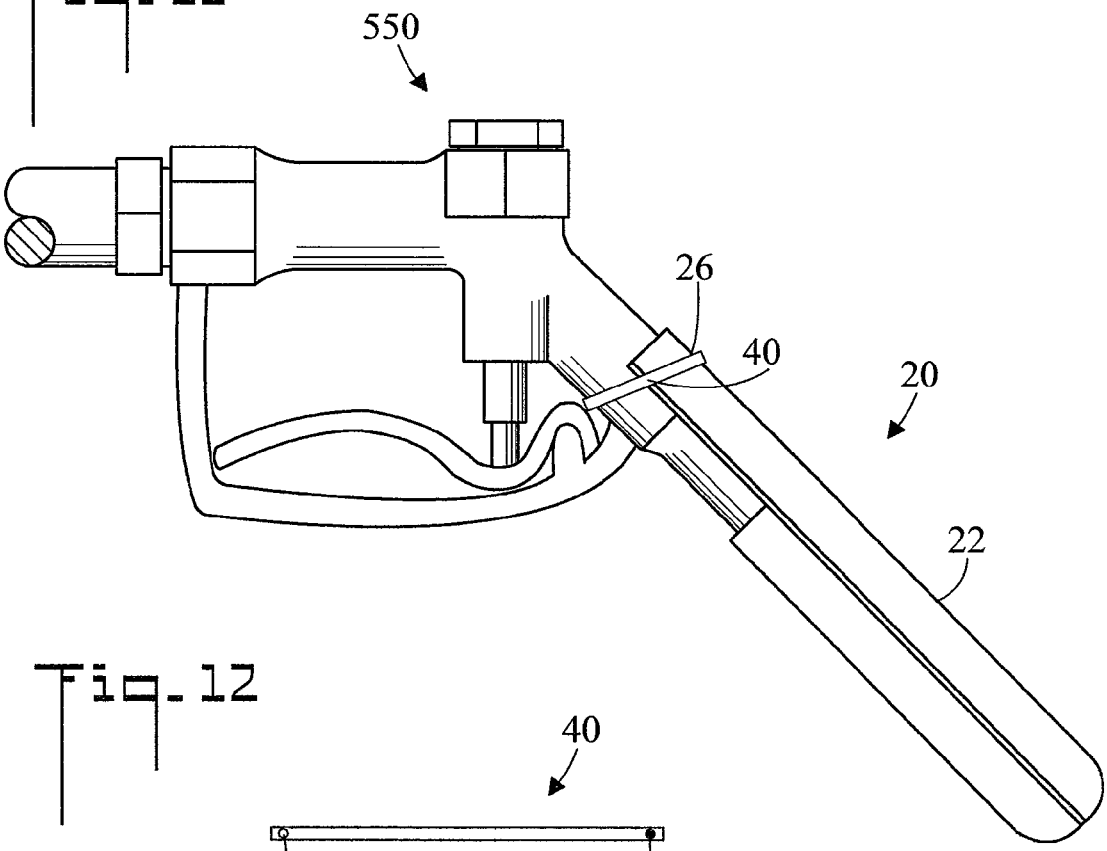
FIG. 11 is a side elevation view of the second embodiment fuel nozzle with the cover installed.
Figure 12:
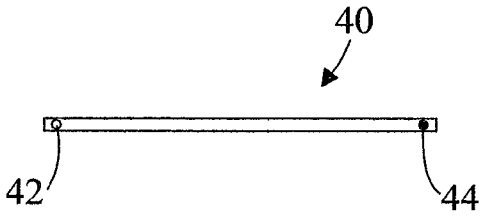
FIG. 12 is a top plan view of a connector for connecting the cover to the second embodiment fuel nozzle.

FIGS. 10 and 11 are top plan and side elevation views respectively of a second embodiment fuel nozzle 550 with cover 20 installed, and FIG. 12 is a top plan view of a connector 40 for connecting cover 20 to the second embodiment fuel nozzle 550. Fuel nozzle 550 does not have an hanger upon which to hang cover 20. As such, cover 20 must be connected to fuel nozzle 550 in a different manner. In the shown embodiment, the connection of cover 20 to fuel nozzle 550 is effected by a connector 40 which holds cover 20 in place on fuel nozzle 550. Connector 40 is shaped and dimensioned to fit through hole 26 in sheath 22. Connector 40 is passed through hole 26 in sheath 22 and then wrapped around fuel nozzle 550 and secured. In the shown embodiment connector 40 includes a strip of flexible material which has a connection means disposed at its ends. In the shown embodiment the connection means comprises cooperating snaps 42 and 44. However, it may be appreciated that clips, hook and loop fasteners, buckles or other means could also be employed. Further, other connectors 40 such as of string, wire, twine, tape, or the like could also be utilized to connect cover 20 to fuel nozzle 550.

Figure 13:
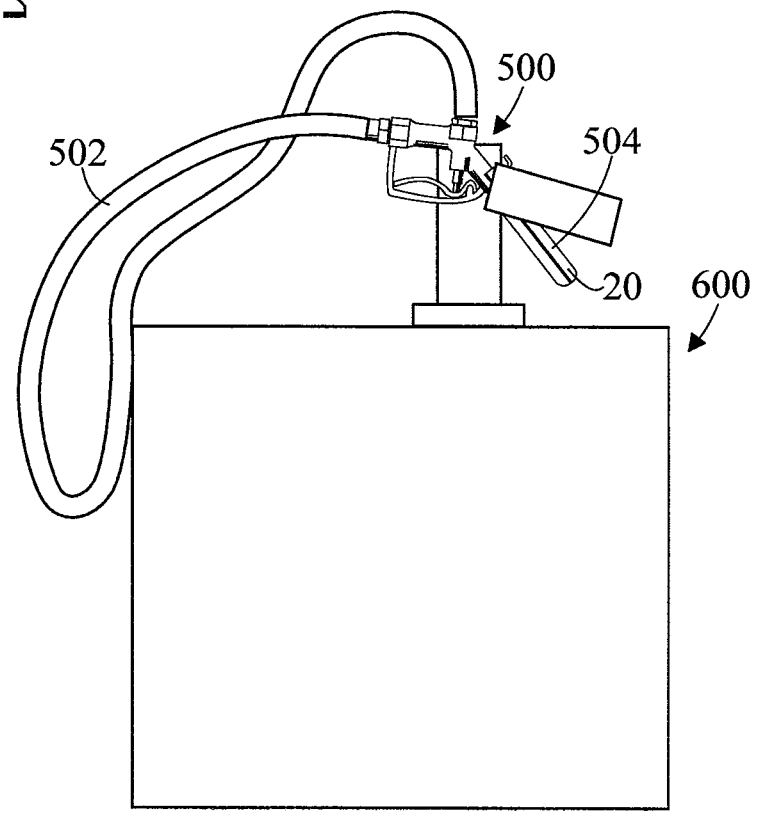
FIG. 13 is a reduced side elevation view of a fuel tank, and a fuel nozzle with the cover installed; and, FIG. 14 is a side elevation view of the cover installed on a portable fuel dispenser.

FIG. 13 is a reduced side elevation view of a fuel tank 600, and a fuel dispenser (nozzle) 500 with cover 20 installed. It is noted that cover 20 is installed when fuel dispenser 500 is stored and not in use. In some instances, fuel dispenser 500 is disposed in an environment which contains contaminants such as dirt and debris. When installed on the spout 504 of the fuel dispenser 500, sheath 22 prevents the contaminants from collecting on the spout 504 of the fuel dispenser 500 (also refer to FIG. 14 and the associated discussion).

Figure 14:
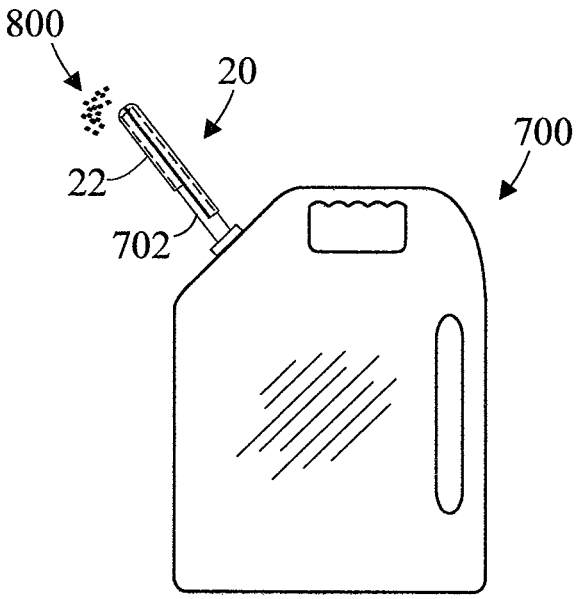

FIG. 14 is a side elevation view of cover 20 installed on the spout 702 of a portable fuel dispenser 700, such as the shown 5 gallon gasoline can. It is noted that fuel dispenser 700 (or 500) is disposed in an environment which contains contaminants 800. When installed on spout 702 (or 504) of the fuel dispenser 700 (or 500), sheath 22 prevents the contaminants 800 from collecting on the spout 702 (or 504) of the fuel dispenser 702 (or 500).

In summary,

- a fuel dispenser cover is used to cover the spout of a fuel dispenser when the fuel dispenser is not in use;
- the fuel dispenser cover comprises a sheath having an elongated cavity (pocket) which is shaped and dimensioned to longitudinally receive the spout of the fuel dispenser;
- the fuel dispenser cover is first positioned so that the cavity receives the end of the fuel dispenser, the fuel dispenser cover is then longitudinally pulled (slipped) over the spout so that it covers same;
- alternatively, the spout is longitudinally inserted into the cavity of the fuel dispenser cover;
- the fuel dispenser cover has a hole which is shaped and dimensioned to receive the hanger of a fuel nozzle, so that the fuel dispenser cover is retained in place on the spout;
- the fuel dispenser cover is connected to the fuel nozzle by placing the hanger through the hole in the fuel dispenser cover so that the fuel dispenser cover hangs from the hanger;
- alternatively a separate connector can be used to connect the fuel dispenser cover to the fuel dispenser;
- the fuel dispenser cover is fabricated from an absorbent material such as one or more layers of fuel absorbent padding which absorbs drips from the spout of the fuel dispenser;
- the fuel dispenser cover is removed by unhooking the fuel dispenser cover from the hanger of a fuel nozzle and sliding the fuel dispenser cover off of the spout;
- alternatively fuel dispenser cover is removed by disconnecting a separate connector which connects fuel dispenser cover to the fuel dispenser.

In terms of use, a method for collecting residual fuel from a fuel dispenser includes: (refer to FIGS. 1-14):

(a) providing a fuel dispenser 500, 700 containing fuel and having a spout 504, 702;

(b) providing a cover 20 for covering the spout 504,702 of the fuel dispenser 500, 700 when the fuel dispenser 500, 700 is not in use, the cover 20 including:

- a sheath 22 having an elongated cavity 24 which is shaped and dimensioned to longitudinally receive the spout 504, 702 of the fuel dispenser 500, 700;
- the sheath 22 fabricated from a fuel absorbent material;

(c) using the fuel dispenser 500, 700 to dispense fuel wherein residual fuel 510 is disposed on the spout 504, 702;

(d) positioning the cover 20 over the spout 504, 702 so that the longitudinal cavity 24 receives the spout 504, 702; and, (e) the cover 20 absorbing the residual fuel 510.

The method further including:

in (a), the fuel dispenser being a fuel nozzle 500 having a hanger 506;

in (b), the sheath 22 having a hole 26 which is shaped and dimensioned to receive the hanger 506 of the fuel nozzle 500; and, in (d), placing the hanger 506 through the hole 26 so that the sheath 22 is retained in place on the spout 504 of the fuel nozzle 500.

The method further including in (b), the sheath 22 having a hole 26; and, providing a connector 40 which is shaped and dimensioned to fit through the hole 26 and be connected around the fuel dispenser 500 to retain the sheath 22 in place on the spout 504 of the fuel dispenser 500; and, in (d), using the connector 40 to connect the sheath 22 to the spout 504.

The method further including:

in (a), the fuel dispenser 500, 700 disposed in an environment which contains contaminants 800; and, in (d), the sheath 22 preventing the contaminants 800 from collecting on the spout 504, 702 of the fuel dispenser 500, 700.

The embodiments of the cover and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the cover and method should be construed as limiting the invention to a particular embodiment or combination of embodiments. The scope of the invention is defined by the appended claims.

I claim:

1. A method for collecting residual fuel from a fuel dispenser, comprising:

(a) providing a fuel dispenser containing fuel and having a spout;

(b) providing a cover for covering said spout of said fuel dispenser when said fuel dispenser is not in use, said cover including:

a sheath having an elongated cavity which is shaped and dimensioned to receive said spout of said fuel dispenser;

said sheath fabricated from a fuel absorbent material;

(c) using said fuel dispenser to dispense fuel wherein residual fuel is disposed on said spout;

(d) positioning said sheath over said spout so that said elongated cavity receives said spout; and, (e) said cover absorbing said residual fuel.

2. The method of claim 1, further including:

in (a), said fuel dispenser being a fuel nozzle having a hanger;

in (b), said sheath having a hole which is shaped and dimensioned to receive said hanger of said fuel nozzle; and, in (d), placing said hanger through said hole so that said sheath is retained in place on said spout of said fuel nozzle.

3. The method of claim 1, further including in (b), said sheath having a hole;

in (b), said cover including a connector which is shaped and dimensioned to fit through said hole and be connected around said fuel dispenser to retain said sheath in place on said spout of said fuel dispenser; and, in (d), using said connector to connect said sheath to said spout.

4. The method of claim 1, further including:

in (a), said fuel dispenser disposed in an environment which contains contaminants; and, in (d), said sheath preventing said contaminants from collecting on said spout of said fuel dispenser.

* * * * *